US008805240B2

(12) United States Patent
Shirai et al.

(10) Patent No.: US 8,805,240 B2
(45) Date of Patent: Aug. 12, 2014

(54) CLEANING DEVICE AND IMAGE FORMING APPARATUS INCORPORATING SAME

(75) Inventors: Katsumi Shirai, Toyokawa (JP); Hideji Higashimura, Toyokawa (JP); Morihisa Kawahara, Toyohashi (JP); Takumi Michibata, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 543 days.

(21) Appl. No.: 12/631,537

(22) Filed: Dec. 4, 2009

(65) Prior Publication Data

US 2010/0143010 A1 Jun. 10, 2010

(30) Foreign Application Priority Data

Dec. 8, 2008 (JP) ..... 2008-312522

(51) Int. Cl.
*G03G 15/20* (2006.01)
*G03G 21/00* (2006.01)

(52) U.S. Cl.
USPC ..... 399/123; 399/349; 399/353; 399/357; 399/358

(58) Field of Classification Search
USPC ..... 399/123, 343, 349, 353, 354, 357, 358, 399/360
See application file for complete search history.

(56) References Cited

U.S. PATENT DOCUMENTS

| | | | | |
|---|---|---|---|---|
| 5,233,398 | A * | 8/1993 | Nimura et al. | 399/354 |
| 5,559,593 | A | 9/1996 | Yoshinaga et al. | |
| 7,469,116 | B2 | 12/2008 | Kitajima | |
| 2003/0049059 | A1 * | 3/2003 | Gross et al. | 399/353 |
| 2005/0232667 | A1 * | 10/2005 | Iwata | 399/353 |

FOREIGN PATENT DOCUMENTS

| | | |
|---|---|---|
| JP | 61-107369 | 5/1986 |
| JP | 4-335695 | 11/1992 |
| JP | 7-306617 | 11/1995 |
| JP | 2001-255749 | 9/2001 |
| JP | 2002-229344 | 8/2002 |
| JP | 2006-343508 | 12/2006 |
| JP | 2007-86199 | 4/2007 |
| JP | 2007-140317 | 6/2007 |
| JP | 2007-310312 | 11/2007 |

OTHER PUBLICATIONS

Japanese Office Action mailed Oct. 5, 2010, directed to counterpart Japanese Application No. 2008-312522; 9 pages.
Decision to Patent Grant mailed Jan. 17, 2012, directed to Japanese Application No. 2008-312522; 5 pages.
Japanese Office Action mailed Jun. 7, 2011, directed to counterpart Japanese Application No. 2008-312522; 9 pages.

* cited by examiner

*Primary Examiner* — Joseph S Wong
(74) *Attorney, Agent, or Firm* — Lucas & Mercanti, LLP

(57) ABSTRACT

There is provided a cleaning device for removing residual toner on an image carrier. The cleaning device includes a housing to cover a specified region of an image carrier. A first cleaning section and a second cleaning section are respectively placed in upper and lower parts of the housing partitioned by a partition member. The first cleaning section includes a first cleaning brush and a first regulating member. The second cleaning section includes a second cleaning brush and a second regulating member. The partition member substantially extends in a continuous manner with respect to a horizontal direction from the specified region to at least a position equivalent to an end portion on a housing sidewall side of the first or the second regulating member. A clearance exists between the housing sidewall and an end portion on the housing sidewall side of the partition member.

11 Claims, 7 Drawing Sheets

CLEANING DEVICE AND IMAGE FORMING APPARATUS INCORPORATING SAME

CROSS-REFERENCE TO RELATED APPLICATION

This application is based on application No. 2008-312522 filed in Japan on Dec. 8, 2008, the entire content of which is hereby incorporated by reference.

TECHNICAL FIELD

The present invention relates to a cleaning device, and more particularly relates to a cleaning device for removing residual toner on an image carrier.

The present invention further relates to an image forming apparatus incorporating such a cleaning device.

BACKGROUND ART

In some conventional cleaning devices of this kind as disclosed in JP 2002-229344 A, an intermediate transfer belt as an image carrier is brought into contact with conductive first cleaning brush and second cleaning brush, and the first cleaning blush is provided with a bias with a polarity (e.g., negative voltage) opposite to the charged polarity (positive polarity in this example) of most of the residual toner on the intermediate transfer belt, while the second cleaning brush is provided with a bias (positive voltage in this example) with the same polarity as the charged polarity of the most of the residual toner. In this cleaning device, most of the residual toner on the intermediate transfer belt is first electrostatically attracted to and cleaned by the first cleaning brush. A small quantity of the opposite polarity toner which was not cleaned by the first cleaning brush is then electrostatically attracted to and cleaned by the second cleaning brush placed downstream from the first cleaning brush.

SUMMARY OF THE INVENTION

Technical Problem

In the shown conventional example, the first cleaning brush is placed beside a region where the intermediate transfer belt rotates about a roller (the region is referred to as "curved region") and is in contact with a part of the curved region. The second cleaning brush is placed below the first cleaning brush and is in contact with a portion of the curved region which is located downstream from the portion with which the first cleaning brush is in contact.

In such layout, the toner attracted to the first cleaning brush may drop from the first cleaning brush or may scatter around. In that case, since the charged polarity (positive polarity in the aforementioned example) of the toner is the same as the bias (positive voltage in the aforementioned example) of the second cleaning brush, the toner is not attracted to the second cleaning brush but is repelled thereby. This causes a problem that the toner scatters around and adheres to the intermediate transfer belt again. Moreover, since the toner adhering to the second cleaning brush increases, the scraping capability of a toner regulating member which is in contact with the second cleaning brush deteriorates, causing a problem of insufficient reliability.

Accordingly, an object of the invention is to provide a reliable cleaning device which can ensure removal of residual toner on an image carrier.

Another object of the invention is to provide an image forming apparatus incorporating such a fixing device.

Solution to Problem

In order to achieve the object, a cleaning device according to a first aspect of the present invention is a cleaning device for removing residual toner on an annular image carrier which moves in a circumferential direction, comprising:

a housing placed beside a specified region of the image carrier with respect to the circumferential direction so as to cover the specified region, the housing having a housing sidewall facing the specified region;

a first cleaning section placed in an upper part within the housing, the first cleaning section including a first cleaning brush which comes into contact with a portion of the specified region and a first regulating member placed closer to a housing sidewall side than the first cleaning brush for scraping toner on the first cleaning brush;

a second cleaning section placed in a lower part within the housing, the second cleaning section including a second cleaning brush which comes into contact with a portion of the specified region downstream from the portion with which the first cleaning brush comes into contact and a second regulating member placed closer to the housing sidewall side than the second cleaning brush for scraping toner on the second cleaning brush; and a partition member substantially extending in a continuous manner with respect to a horizontal direction from the specified region to at least a position equivalent to an end portion on the housing sidewall side of the first or the second regulating member so as to partition the housing into the first cleaning section and the second cleaning section; wherein a clearance exists between the housing sidewall and an end portion on the housing sidewall side of the partition member with respect to a horizontal direction.

In this specification, the term, "annular" image carrier, includes image carriers of endless belt type as well as of cylindrical type. The image carrier of endless belt type may take any shape as a whole as long as the entire belt shape forms a closed loop. For example, the image carrier may be in flat and generally plate-like shape, generally convex polygon shape, and in concave shape. With the entire belt having generally a plate-like shape, the belt may be placed with an inclination with respect to the horizontal direction.

The term "residual toner" refers to a toner remaining on an image carrier after processing (e.g., transfer process from the image carrier to a recording medium) is applied to the image carrier. The most part of such residual toner is considered to be charged with either positive or negative polarity.

Moreover, the phrase that "being placed beside" the specified region of an image carrier is used to refer to the action of not only being placed just beside but also of being placed on a obliquely upper side or on a obliquely lower side.

In the cleaning device of the first aspect, most of the residual toner on the image carrier is first removed from the image carrier by the first cleaning brush as the image carrier moves in the circumferential direction. The toner on the first cleaning brush is scraped by the first regulating member. The toner scraped by the first regulating member drops to the bottom of the housing through the clearance between the housing sidewall and the end portion on the housing sidewall side of the partition member. Next, a small quantity of the toner which was not cleaned by the first cleaning brush is removed from the image carrier by the second cleaning brush placed downstream from the first cleaning brush. The toner on the second cleaning brush is scraped by the second regulating member. The toner scraped by the second regulating member drops to the bottom of the housing.

In this case, even when toner falls directly underneath from the first cleaning brush and from the first regulating member of the first cleaning section or scatters around, the second cleaning section is protected from the toner by the partition member. This prevents occurrence of the conventional problem of such toner scattering from the second cleaning section and adhering onto the image carrier again. Therefore, the cleaning device can ensure removal of the residual toner on the image carrier. Moreover, since the toner adhering to the second cleaning brush decreases, sufficient scraping capability of the toner regulating member which is in contact with the second cleaning brush can be maintained. This results in enhanced reliability.

In a typical example, the first cleaning brush is provided with a bias voltage whose polarity is opposite to the main charged polarity of the residual toner on the image carrier, whereas the second cleaning brush is provided with a bias voltage whose polarity is opposite to the first cleaning brush. In that case, as the image carrier moves in the circumferential direction, most of the residual toner on the image carrier is first mechanically scraped by the first cleaning brush while it is electrostatically attracted thereto and is removed from the image carrier. The toner on the first cleaning brush is scraped by the first regulating member. The toner scraped by the first regulating member drops to the bottom of the housing through the clearance between the housing sidewall and the end portion on the housing sidewall side of the partition member. Next, a small quantity of the opposite polarity toner which was not cleaned by the first cleaning brush is mechanically scraped by the second cleaning brush placed downstream from the first cleaning brush while it is electrostatically attracted thereto and is removed from the image carrier. The toner on the second cleaning brush is scraped by the second regulating member. The toner scraped by the second regulating member drops to the bottom of the housing.

A cleaning device according to a second aspect of the present invention is a cleaning device for removing residual toner on an annular image carrier which moves in a circumferential direction, comprising:

a housing placed beside a specified region of the image carrier with respect to the circumferential direction so as to cover the specified region, the housing having a housing sidewall facing the specified region;

a first cleaning section placed in an upper part within the housing, the first cleaning section including a first cleaning brush which comes into contact with a portion of the specified region, a first collection roller placed closer to a housing sidewall side than the first cleaning brush for attracting toner on the first cleaning brush, and a first regulating member placed closer to the housing sidewall side than the first collection roller for scraping toner on the first collection roller;

a second cleaning section placed in a lower part within the housing, the second cleaning section including a second cleaning brush which comes into contact with a portion of the specified region downstream from the portion with which the first cleaning brush comes into contact, a second collection roller placed closer to the housing sidewall side than the second cleaning brush for attracting toner on the second cleaning brush, and a second regulating member placed closer to the housing sidewall side than the second collection roller for scraping toner on the second collection roller; and a partition member substantially extending in a continuous manner with respect to a horizontal direction from the specified region to at least a position equivalent to an end portion on the housing sidewall side of the first or the second regulating member so as to partition the housing into the first cleaning section and the second cleaning section; wherein a clearance exists between the housing sidewall and an end portion on the housing sidewall side of the partition member with respect to a horizontal direction.

In the cleaning device of the second aspect, most of the residual toner on the image carrier is first removed from the image carrier by the first cleaning brush as the image carrier moves in the circumferential direction. The toner on the first cleaning brush is transferred onto the first collection roller, and the toner on the first collection roller is then scraped by the first regulating member. The toner scraped by the first regulating member drops to the bottom of the housing through the clearance between the housing sidewall and the end portion on the housing sidewall side of the partition member. Next, a small quantity of the toner which was not cleaned by the first cleaning brush is removed from the image carrier by the second cleaning brush placed downstream from the first cleaning brush. The toner on the second cleaning brush is transferred onto the second collection roller, and the toner on the second collection roller is then scraped by the second regulating member. The toner scraped by the second regulating member drops to the bottom of the housing.

In this case, even when toner falls from the first cleaning brush, the first collection roller and from the first regulating member of the first cleaning section directly underneath or scatters around, the second cleaning section is protected from the toner by the partition member. This prevents occurrence of the conventional problem of such toner scattering from the second cleaning section and adhering onto the image carrier again. Therefore, the cleaning device can ensure removal of the residual toner on the image carrier. Moreover, since the toner adhering to the second cleaning brush decreases, sufficient scraping capability of the toner regulating member which is in contact with the second cleaning brush can be maintained. This results in enhanced reliability.

In a typical example, the first collection roller is provided with a bias voltage whose polarity is opposite to the main charged polarity of the residual toner on the image carrier. As a result, the first cleaning brush is charged with the same polarity as the first collection roller, whereas the second collection roller is provided with a bias voltage whose polarity is opposite to the first cleaning brush. Therefore, the second cleaning brush is charged with the same polarity as the second collection roller. In that case, as the image carrier moves in the circumferential direction, most of the residual toner on the image carrier is first mechanically scraped by the first cleaning brush while it is electrostatically attracted thereto and is removed from the image carrier. The toner on the first cleaning brush is transferred onto the first collection roller, and the toner on the first collection roller is then scraped by the first regulating member. The toner scraped by the first regulating member drops to the bottom of the housing through the clearance between the housing sidewall and the end portion on the housing sidewall side of the partition member. Next, a small quantity of the opposite polarity toner which was not cleaned by the first cleaning brush is mechanically scraped by the second cleaning brush placed downstream from the first cleaning brush while it is electrostatically attracted thereto and is removed from the image carrier. The toner on the second cleaning brush is transferred onto the second collection roller, and the toner on the second collection roller is then scraped by the second regulating member. The toner scraped by the second regulating member drops to the bottom of the housing.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Hereinbelow, the invention will be described in detail in conjunction with the embodiments with reference to the drawings.

Figure 1:
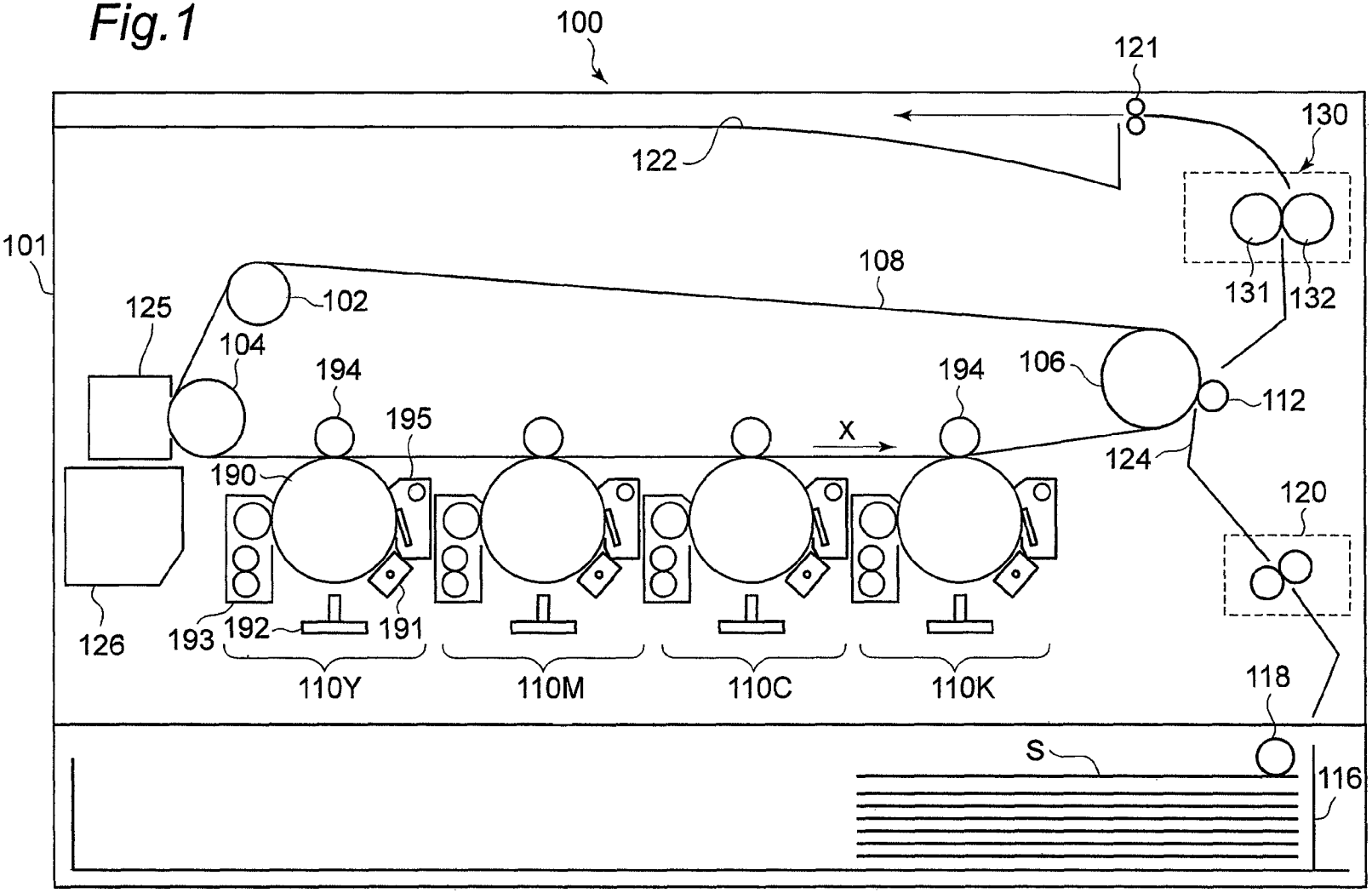
FIG. 1 is a view showing the overall structure of an image forming apparatus including a cleaning device in one embodiment of the invention.

FIG. 1 shows the sectional configuration of an image forming apparatus 100 of color tandem system incorporating a cleaning device 125 in one embodiment. The image forming apparatus 100 includes an intermediate transfer belt 108 as an annular image carrier generally in the center inside a main body casing 101, the intermediate transfer belt 108 being wound around three rollers 102, 104 and 106 and moving in the circumferential direction. Among three rollers, two rollers 102 and 104 are placed on the left-hand side in the drawing with an interval therebetween, while the remaining roller 106 is placed on the right-hand side in the drawing. The intermediate transfer belt 108 is supported on these rollers 102, 104 and 106, and is rotated in an arrow X direction.

Imaging units 110Y, 110M, 110C and 110K as image forming sections corresponding to respective color toners of yellow (Y), magenta (M), cyan (C) and black (K) are placed below the intermediate transfer belt 108 side by side in order from the left-hand side in the drawing.

The respective imaging units 110Y, 110M, 110C and 110K have completely similar configuration except for a difference in toner color that the respective units handle. More specifically, the imaging unit 110Y is integrally composed of, for example, a photoconductor drum 190, a charging device 191, an exposure device 192, a developing device 193 for development with use of toner, and a cleaning device 195. A primary transfer roller 194 is provided at a position facing the photoconductor drum 190 across the intermediate transfer belt 108. At the time of image formation, the surface of the photoconductor drum 190 is first uniformly charged by the charging device 191, and then the surface of the photoconductor drum 190 is exposed by the exposure device 192 in response to an image signal inputted from an unshown external unit to form a latent image thereon. Next, the latent image on the surface of the photoconductor drum 190 is developed into a toner image by the developing device 193. The toner image is transferred onto the intermediate transfer belt 108 upon voltage impression between the photoconductor drum 190 and the primary transfer roller 194. The transfer residual toner on the surface of the photoconductor drum 190 is cleaned by the cleaning device 195.

As the intermediate transfer belt 108 moves in the arrow X direction, overlapped toner images of four colors are formed on the intermediate transfer belt 108 by each of the imaging units 110Y, 110M, 110C and 110K.

Provided on the left-hand side of the intermediate transfer belt 108 are a cleaning device 125 for removing residual toner from the surface of the intermediate transfer belt 108 and a toner collection box 126 for collecting the toner removed by the cleaning device 125. A secondary transfer roller 112 is provided on the right-hand side of the intermediate transfer belt 108 across a conveying path 124 for paper sheets. A fixing unit 130 for fixing toner onto paper sheets is provided on the upper right part inside the main body casing 101. The fixing unit 130 includes a heating roller 131 and a pressure roller 132 extending vertically with respect to the page of FIG. 1. In this example, the heating roller 131 incorporates an unshown heating source. The pressure roller 132 is biased toward the heating roller 131 with an unshown spring. Accordingly, the heating roller 131 and the pressure roller 132 form a nip section for fixation. As a paper sheet S carrying a toner image transferred thereon passes through the nip section, the toner image is fixed onto the paper sheet S. A paper cassette 116 which stores paper sheets S as recording media is provided in the lower part of the main body casing 101.

At the time of image formation, paper sheets S are sent out by a feed roller 118 sheet by sheet from the paper cassette 116 to the conveying path 124, and are sent into a toner transfer position between the intermediate transfer belt 108 and the secondary transfer roller 112 by a conveying roller 120. Meanwhile, an overlapped toner image of four colors is formed on the intermediate transfer belt 108 by each of the imaging units 110Y, 110M, 110C and 110K as mentioned before. By the secondary transfer roller 112, the toner image of four colors on the intermediate transfer belt 108 is transferred onto a paper sheet S which was sent into the above-mentioned toner transfer position. The paper sheet S with the toner image transferred thereon receives heat and pressure while being conveyed through the nip section formed between the heating roller 131 and the pressure roller 132 of the fixing unit 130. As a result, the toner image is fixed onto the sheet S. The paper sheet S with the toner image fixed thereto is then discharged by a paper ejecting roller 121 into a paper ejection tray section 122 provided on the upper surface of the main body casing 101.

Figure 2:
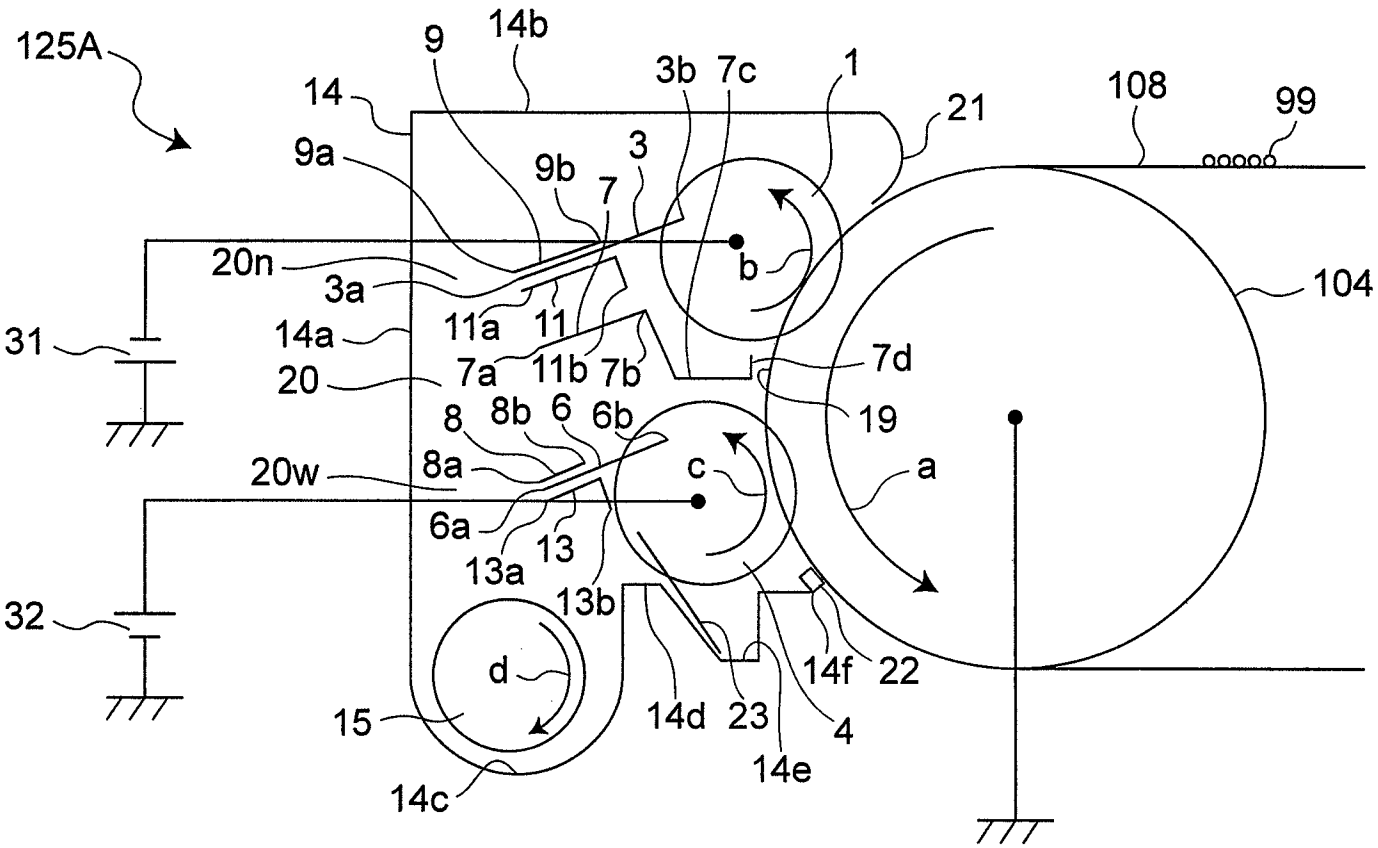
FIG. 2 is a view showing the sectional configuration of a cleaning device in one embodiment of the invention.

FIG. 2 shows a concrete configuration example of the cleaning device 125 (denoted by reference sign 125A).

The cleaning device 125A includes a housing 14 which is made of an insulating material and placed beside a curved region 19, which constitutes a specified region of the intermediate transfer belt 108 with respect to a circumferential direction, so as to cover the curved region 19. A space between the housing 14 and the curved region 19 is closed by seals 21 and 22. The curved region 19 is equivalent to a circular-arc portion of the intermediate transfer belt 108, the portion wound about the roller 104 in this example. At the time of operation, the curved region 19 of the intermediate transfer belt 108 moves rotating counterclockwise as shown by an arrow a in FIG. 2 together with the roller 104.

Residual toner 99 which was not transferred onto a paper sheet by the secondary transfer roller 112 in the transfer process adheres onto the intermediate transfer belt 108 which reaches the cleaning device 125A. In this example, the main charged polarity of the residual toner 99 on the intermediate transfer belt 108 is positive, and most of the residual toner 99 is assumed to be charged with a positive polarity.

The housing 14 includes a plate-like sidewall 14*a* placed in the perpendicular direction facing the curved region 19, a top plate 14*b*, and bottom sections 14*c*, 14*d*, 14*e* and 14*f*. Hereinafter in FIG. 2, the housing sidewall 14*a* side is referred to as the left-hand side, and the curved region 19 side as the right-hand side. The inside of the housing 14 is partitioned into an upper part and a lower part with a partition member 7 which is made of an insulating material.

The upper part of the housing 14 houses a cleaning brush 1 as a first cleaning brush which is made of a conductive material and which comes into contact with a portion of the curved region 19, and a regulating member 3 as a first regulating member which is made of a conductive material and which is placed on the left-hand side of the cleaning brush 1 for scraping the toner on the cleaning brush 1. In this example, the cleaning brush 1 and the regulating member 3 constitute a first cleaning section.

The cleaning brush 1, which is rotatably supported at opposite ends in the longitudinal direction of the housing 14, is rotated counterclockwise as shown by an arrow b in FIG. 2 by an unshown driving source at the time of operation (a contact section of the cleaning brush 1 moves relative to the intermediate transfer belt 108 in a counter direction).

The regulating member 3 is fixed to the housing 14 in the state of being interposed in between a pair of upper and lower retaining members 9 and 11. The upper retaining member 9 has a plate-like shape, with right and left end portions 9*a* and 9*b* of the retaining member 9 being placed along the regulating member 3. The lower retaining member 11 is bent to have an L-shaped cross section. More specifically, a left-side end portion 11*a* of the retaining member 11 is placed along the regulating member 3, while a right-side end portion 11*b* is bent obliquely toward lower right (toward a later-described protruding section 7*b* of the partition member 7). The regulating member 3, as well as the upper retaining member 9, is inclined to have a left-side end portion lower than a right-side end portion so that the toner carried on the upper surface flows to the left-hand side.

The left-side end portions 9*a*, 3*a* and 11*a* of the retaining member 9, the regulating member 3 and the retaining member 11 are at positions generally aligned with each other. Hereinafter, the left-side end portions 9*a*, 3*a* 11*a* of the retaining member 9, the regulating member 3 and the retaining member 11 are simply referred to as "the left-side end portion 3*a* of the regulating member 3". A clearance 20*n* is horizontally provided between the left-side end portion 3*a* of the regulating member 3 and the housing sidewall 14*a*.

The lower part in the housing 14 houses a cleaning brush 4 as a second cleaning brush made of a conductive material, the cleaning brush 4 coming into contact with a portion of the curved region 19 downstream from the portion with which the cleaning brush 1 comes into contact, and a regulating member 6 as a second regulating member which is made of a conductive material and which is placed on the left-hand side of the cleaning brush 4 for scraping the toner on the cleaning brush 4. In this example, the cleaning brush 4 and the regulating member 6 constitute a second cleaning section.

The cleaning brush 4, which is rotatably supported at opposite ends in the longitudinal direction of the housing 14, is rotated counterclockwise as shown by an arrow c in FIG. 2 by an unshown driving source at the time of operation (a contact section of the cleaning brush 4 moves relative to the intermediate transfer belt 108 in a counter direction).

It is to be noted that in this example, the contact sections of the cleaning brushes 1 and 4 are set to move relative to the intermediate transfer belt 108 in the counter direction for efficient toner collection. However, it is preferable for the contact sections of the cleaning brushes 1 and 4 to move relative to the intermediate transfer belt 108 in the same direction from a viewpoint of reducing driving torque of the cleaning brushes 1 and 4.

The regulating member 6 is fixed to the housing 14 in the state of being interposed in between a pair of upper and lower retaining members 8 and 13. The upper retaining member 8 has a plate-like shape, with right and left end portions 8*a* and 8*b* of the retaining member 8 being placed along the regulating member 6. The lower retaining member 13 is bent to have an L-shaped cross section. More specifically, a left-side end portion 13*a* of the retaining member 13 is placed along the regulating member 6, while a right-side end portion 13*b* is bent obliquely toward lower right (toward a later-described protruding section 14*d* on the bottom of the housing). The regulating member 6, as well as the upper retaining member 8, is inclined to have a left-side end portion lower than a right-side end portion so that the toner carried on the upper surface flows to the left-hand side.

The left-side end portions 8*a*, 6*a* and 13*a* of the retaining member 8, the regulating member 6 and the retaining member 13 are at positions generally aligned with each other. Hereinafter, the left-side end portions 8*a*, 6*a* 13*a* of the retaining member 8, the regulating member 6 and the retaining member 13 are simply referred to as "the left-side end portion 6*a* of the regulating member 6". A clearance 20*w* is horizontally provided between the left-side end portion 6*a* of the regulating member 6 and the housing sidewall 14*a*. The clearance 20*w* in the second cleaning section is set to be horizontally wider than the clearances 20*n* in the first cleaning section.

The partition member 7 substantially extends in a continuous manner with respect to a horizontal direction from the specified region 19 to at least a position equivalent to a point between the left-side end portion 3*a* of the regulating member 3 and the left-side end portion 6*a* of the regulating member 6.

The partition member 7 is composed of, in order from the left-hand side, a protruding section 7*b* protruding upward from the level of a left-side end portion 7*a* in generally a triangular shape in cross section, a hollow section 7*c* having a side surface inclined to a lower right side from the protruding section 7*b*, and an end portion 7*d* standing up from the bottom level of the hollow section 7*c* along the curved region 19. A clearance 20 is horizontally provided between the left-side end portion 7*a* of the partition section 7 and the housing sidewall 14*a*. The clearance 20 is set to be horizontally wider than the clearances 20*n* in the first cleaning section and narrower than the clearance 20*w* in the second cleaning section.

In other words, the left-side end portion 3*a* of the regulating member 3 is closer to the housing sidewall 14*a* than the left-side end portion 7*a* of the partition member 7. The left-side end portion 7*a* of the partition member 7 is closer to the housing sidewall 14*a* than the left-side end portion 6*a* of the regulating member 6.

On the bottom of the housing 14 positioned below the second cleaning section, there are provided, in order from the sidewall 14*a* side, a recess-shaped toner receiving section 14*c*, a protruding section 14*d* protruding upward, a hollow section 14*e* having a side surface inclined to a lower right side from the protruding section 14*d*, and an end portion 14*f* which faces the curved region 19. The toner receiving section 14*c* is depressed in a semicircular shape so as to smoothly receive the toner dropped from the regulating member 3, the regulating member 6, or from the partition member 7.

The toner receiving section 14*c* includes a conveying screw 15. At the time of operation, the conveying screw 15 is rotated clockwise as shown by an arrow d in FIG. 2 by an unshown driving source. Accordingly, the toner dropped onto the toner receiving section 14*c* is conveyed in the longitudinal direction of the housing 14 and is discharged out of the housing 14.

An elastic sheet 23 is attached to a slope on the left-hand side of the hollow section 14*e*. The elastic sheet 23 extends obliquely upward along the slope on the left-hand side of the hollow section 14*e* and is in contact with the cleaning brush 4. This prevents the toner, which was pushed up by the conveying screw 15, from flowing from the toner receiving section 14*c* to the right-hand side.

Figure 4:
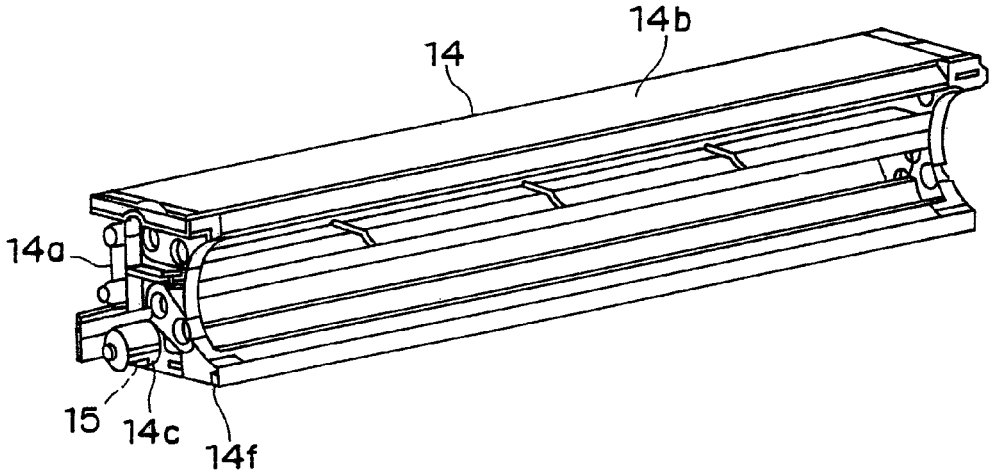
FIG. 4 is a view showing a housing of each cleaning device seen from a obliquely upper side.

FIG. 4 shows the housing 14 as seen from a obliquely upper side. The housing 14 extends in an elongated shape along the width direction of the intermediate transfer belt 108 (curved region 19) shown in FIG. 2. The cleaning brush 1, the regulating member 3, the cleaning brush 4, the regulating member 6, and the partition member 7 extend in an elongated shape, having the same cross section as the cross section shown in FIG. 2 along from one end portion to the other end portion in the longitudinal direction of the housing 14. The conveying screw 15 projects out of the housing 14 through a front wall surface of the housing 14 in FIG. 4.

As shown in FIG. 2, at the time of operation, bias voltages with polarity opposite to each other are applied to the cleaning brush 1 and the cleaning brush 4 from power sources 31 and 32 as the bias voltage application sections. In this example, the cleaning brush 1 is provided with a negative voltage whose polarity is opposite to that of the main charged polarity (positive) of the residual toner 99 on the intermediate transfer belt 108, whereas the cleaning brush 4 is provided with a positive voltage whose polarity is opposite to that of the cleaning brush 1. The roller 104 is grounded.

As the intermediate transfer belt 108 moves in the circumferential direction as shown by an arrow a in FIG. 2, most of the positively charged residual toner 99 on the intermediate transfer belt 108 is first mechanically scraped by the cleaning brush 1 while it is electrostatically attracted thereto and is removed from the intermediate transfer belt 108. The toner on the first cleaning brush 1 is scraped by the regulating member 3. The toner scraped by the regulating member 3 flows on the upper surface of the regulating member 3 and the retaining member 9 toward the left-hand side, and then drops down from the end portion 3*a* of the regulating member 3.

In this example, the left-side end portion 3*a* of the regulating member 3 is closer to the housing sidewall 14*a* than the left-side end portion 7*a* of the partition member 7 and the left-side end portion 6*a* of the regulating member 6. Therefore, the toner dropped down from the end portion 3*a* of the regulating member 3 does not land onto the partition member 7 and/or the regulating member 6, but falls smoothly to the bottom of the housing 14, more precisely to the toner receiving section 14*c*.

Next, a small quantity of negatively charged toner which was not cleaned by the cleaning brush 1 is mechanically scraped by the cleaning brush 4 placed downstream from the cleaning brush 1 while it is electrostatically attracted thereto and is removed from the intermediate transfer belt 108. The toner on the cleaning brush 4 is scraped by the regulating member 6. Thus, the intermediate transfer belt 108 is efficiently cleaned. The toner scraped by the regulating member 6 flows on the upper surface of the regulating member 6 and the retaining member 8 toward the left-hand side, and then drops from the end portion 6*a* of the regulating member 6 to the bottom of the housing 14, more precisely to the toner receiving section 14*c*.

It is to be noted that the cleaning brush 4 is made to mainly attract control-toner patterns on the transfer belt for occasions other than imaging operation with secondary transfer process, and toner images remaining on the transfer belt at the time of paper jam.

As described before, the toner which dropped to the toner receiving section 14*c* is conveyed in the longitudinal direction of the housing 14 by the conveying screw 15, and is discharged out of the housing 14 (more specifically, discharged to the toner collection box 126 shown in FIG. 1). Since the toner receiving section 14*c* is depressed in a semicircular shape, scattering of the toner within the housing 14 is suppressed. In the cleaning device 125A, even when toner drops from the cleaning brush 1 and the regulating member 3 of the first cleaning section in FIG. 2 directly underneath or scatters around, the second cleaning section is protected from the toner by the partition member 7. This prevents occurrence of the conventional problem of such toner scattering from the second cleaning section and adhering onto the intermediate transfer belt 108 again. Therefore, the cleaning device 125A can ensure removal of the residual toner 99 on the intermediate transfer belt 108. Moreover, since the toner adhering to the cleaning brush 4 decreases, sufficient scraping capability of the regulating member 6 which is in contact with the cleaning brush 4 can be maintained. This results in enhanced reliability. Moreover, since the partition member 7 is made of an insulating material, it can electrically insulate between the first cleaning section and the second cleaning section, so that safety can be enhanced.

The toner dropped onto the protruding section 7*b* of the partition member 7 diverges in right and left sides with the presence of the protruding section 7*b*. The toner diverged in the left-hand side with the protruding section 7*b* flows to the left-hand side along the slope on the left-hand side of the protruding section 7*b*, and drops down from the left-side end portion 7*a* of the partition member 7. In this example, the left-side end portion 7*a* of the partition member 7 is closer to the housing sidewall 14*a* than the left-side end portion 6*a* of the regulating member 6. Therefore, the toner dropped down from the left-side end portion 7*a* of the regulating member 7 does not land onto the regulating member 6, but falls smoothly to the bottom of the housing 14, more precisely to the toner receiving section 14*c*. The toner diverged in the right-hand side with the protruding section 7*b* flows to the right-hand side along the slope on the right-hand side of the protruding section 7*b*, and accumulates in the hollow section 7*c* with the toner which directly dropped on the hollow section 7*c*.

Moreover, the right-side end portion lib of the retaining member 11 in the first cleaning section is positioned near the top of the protruding section 7*b* of the partition member 7. This prevents the toner from flowing from the left-hand side to the right-hand side of the protruding section 7*b* in the first cleaning section.

Further, the right-side end portion 13*b* of the retaining member 13 is near the upper end of the elastic sheet 23. This prevents the toner, which was pushed up by the conveying screw 15, from flowing from the toner receiving section 14*c* to the right-hand side.

In this example, the regulating member 3 and the partition member 7 extend in an elongated shape from one end portion to the other end portion in the longitudinal direction of the housing 14. In short, the size of the clearance 20 between the left-side end portion 7*a* of the partition member 7 and the housing sidewall 14*a* along the longitudinal direction is substantially identical to (or it may be longer than) the size of the regulating member 3 along the longitudinal direction. Therefore, the toner dropped from the left-side end portion 3*a* of the regulating member 3 smoothly falls to the bottom of the housing 14 through the clearance 20 along the entire region in the longitudinal direction. This prevents such failure of the toner dropped from the end portion on the sidewall 14*a* side of the regulating member 3 stagnating in the vicinity of opposite ends in the longitudinal direction of the clearance 20.

Figure 3:
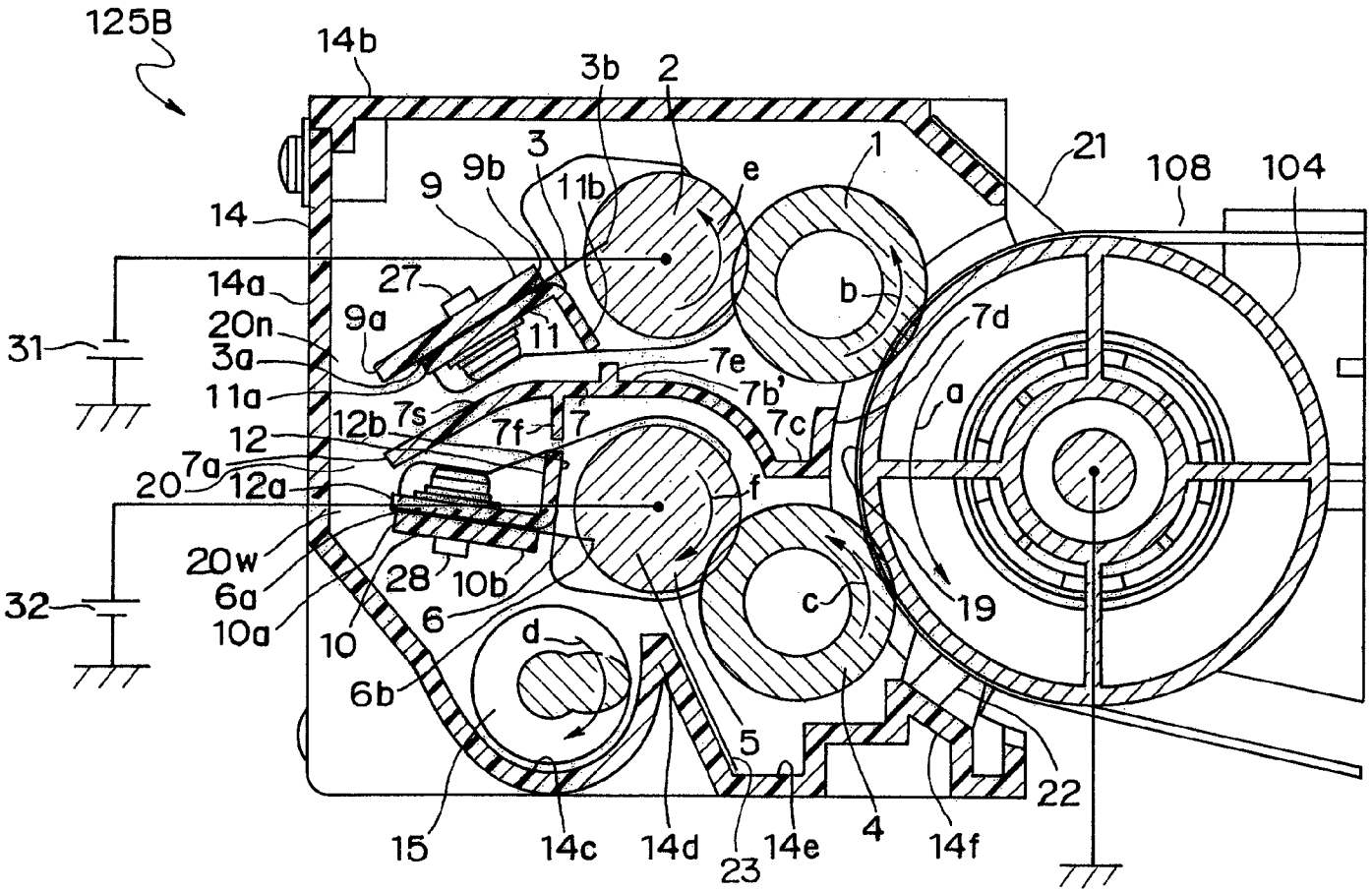
FIG. 3 is a view showing the sectional configuration of a cleaning device in another embodiment of the invention.

FIG. 3 shows a configuration example (denoted by reference sign 125B) of the cleaning device 125 different from that in FIG. 2. In FIG. 3, component members identical to those in FIG. 2 are designated by identical reference signs. Thereby, duplicated explanation will be omitted appropriately.

In the cleaning device 125B, the housing 14, as with the example of FIG. 2, is partitioned into an upper part and a lower part by a partition member 7 which is made of an insulating material.

The upper part of the housing 14 houses a cleaning brush 1 as a first cleaning brush which is made of a conductive material and which comes into contact with a portion of the curved region 19, a collection roller 2 as a first collection roller which is made of a conductive material and which is placed on the left-hand side of the cleaning brush 1 for attracting the toner on the cleaning brush 1, and a regulating member 3 as a first regulating member which is made of a conductive material and which is placed on the left-hand side of the collection roller 2 for scraping the toner on the collection roller 2. In this example, the cleaning brush 1, the collection roller 2 and the regulating member 3 constitute a first cleaning section.

The cleaning brush 1, which is rotatably supported at opposite ends in the longitudinal direction of the housing 14 as in the example of FIG. 2, is rotated counterclockwise as shown by an arrow b in FIG. 3 by an unshown driving source at the time of operation (a contact section of the cleaning brush 1 moves relative to the intermediate transfer belt 108 in a counter direction).

The collection roller 2, which is rotatably supported at opposite ends in the longitudinal direction of the housing 14 as with the cleaning brush 1, is rotated counterclockwise as shown by an arrow e in FIG. 3 by an unshown driving source at the time of operation (the collection roller 2 moves relative to the cleaning brush 1 in a counter direction).

It is to be noted that in this example, a contact section of the collection roller 2 is set to move relative to the cleaning brush 1 in the counter direction for efficient toner collection. However, it is preferable for the contact section of the collection roller 2 to move relative to the cleaning brush 1 in the same direction from a viewpoint of reducing driving torque of the collection roller 2.

The regulating member 3, as in the example of FIG. 2, is fixed to the housing 14 in the state of being interposed in between a pair of upper and lower retaining members 9 and 11. The retaining members 9 and 11 are fixed with a plurality of screws 27 screwed into unshown boss holes provided in a plurality of places (two places in this example) away from each other in the longitudinal direction of the regulating member 3. The retaining members 9 and 11 have functions of holding the regulating member 3 and enhancing the rigidity of the regulating member 3 to bring the regulating member 3 into contact with the collection roller 2 with respect to the longitudinal direction with uniform pressing force.

Left-side end portions 9*a* and 3*a* of the retaining member 9 and the regulating member 3 are at positions generally aligned with each other. Hereinafter, the left-side end portions 9*a* and 3*a* of the retaining member 9 and the regulating member 3 are simply referred to as "the left-side end portion 3*a* of the regulating member 3". A clearance 20*n* is horizontally provided between the left-side end portion 3*a* of the regulating member 3 and the housing sidewall 14*a*.

The lower part in the housing 14 houses a cleaning brush 4 as a second cleaning brush made of a conductive material, the cleaning brush 4 coming into contact with a portion of the curved region 19 downstream from the portion with which the cleaning brush 1 comes into contact, a collection roller 5 as a second collection roller which is made of a conductive material and which is placed on the left-hand side of the cleaning brush 4 for attracting the toner on the cleaning brush 4, and a regulating member 6 as a second regulating member which is made of a conductive material and which is placed on the left-hand side of the collection roller 5 for scraping the toner on the collection roller 5. In this example, the cleaning brush 4, the collection roller 5 and the regulating member 6 constitute a second cleaning section.

The cleaning brush 4, which is rotatably supported at opposite ends in the longitudinal direction of the housing 14 as in the example of FIG. 2, is rotated counterclockwise as shown by an arrow c in FIG. 3 by an unshown driving source at the time of operation (the cleaning brush 4 moves relative to the intermediate transfer belt 108 in a counter direction).

The collection roller 5, which is rotatably supported at opposite ends in the longitudinal direction of the housing 14 as with the cleaning brush 4, is rotated counterclockwise as shown by an arrow f in FIG. 3 by an unshown driving source at the time of operation (a contact section of the collection roller 5 moves relative to the cleaning brush 4 in an identical direction).

The regulating member 6 is fixed to the housing 14 in the state of being interposed in between a pair of upper and lower retaining members 12 and 10. The retaining members 12 and 10 are fixed with a plurality of screws 28 screwed into unshown boss holes provided in a plurality of places (two places in this example) away from each other in the longitudinal direction of the regulating member 6. The retaining members 12 and 10 have functions of holding the regulating member 6 and enhancing the rigidity of the regulating member 6 to bring the regulating member 6 into contact with the collection roller 5 with respect to the longitudinal direction with uniform pressing force.

The upper retaining member 12 is bent to have an L-shaped cross section. More specifically, a left-side end portion 12*a* of the retaining member 12 is placed along the regulating member 6, while a right-side end portion 12*b* is bent obliquely toward upper right (toward a later-described rib 7*f* of the partition member 7). The lower retaining member 10 has a plate-like shape, with right and left end portions 10*a* and 10*b* of the retaining member 10 being placed along the regulating member 6. The retaining member 12, as well as the regulating member 6, is bent to have an L-shaped corner section lower than the left-side end portion 12*a* so that the toner carried on the upper surface accumulates in the corner section.

The left-side end portions 12*a*, 6*a* and 10*a* of the retaining member 12, the regulating member 6 and the retaining member 10 are at positions generally aligned with each other. Hereinafter, the left-side end portions 12*a*, 6*a* and 10*a* of the retaining member 12, the regulating member 6 and the retaining member 10 are simply referred to as "the left-side end portion 6*a* of the regulating member 6". A clearance 20*w* is horizontally provided between the left-side end portion 6*a* of the regulating member 6 and the housing sidewall 14*a*. The clearance 20*w* in the second cleaning section is set to be horizontally wider than the clearance 20*n* in the first cleaning section.

The partition member 7 substantially extends in a continuous manner with respect to a horizontal direction from the specified region 19 to at least a position equivalent to a point between the left-side end portion 3*a* of the regulating member 3 and the left-side end portion 6*a* of the regulating member 6.

The partition member 7 is composed of, in order from the left-hand side, a slope 7*s* inclined from the level of a left-side end portion 7*a* toward an upper right side, a curved section 7*b*' which curves upward to have a protruding cross section, a hollow section 7*c* depressed relative to the curved section 7*b*', and an end portion 7*d* standing up from the bottom level of the hollow section 7*c* along the curved region 19. A clearance 20 is horizontally provided between the left-side end portion 7*a* of the partition section 7 and the housing sidewall 14*a*. The clearance 20 is set to be horizontally wider than the clearances 20*n* in the first cleaning section and narrower than the clearance 20*w* in the second cleaning section.

In other words, the left-side end portion 3*a* of the regulating member 3 is closer to the housing sidewall 14*a* than the left-side end portion 7*a* of the partition member 7. The left-side end portion 7*a* of the partition member 7 is closer to the housing sidewall 14*a* than the left-side end portion 6*a* of the regulating member 6.

Figure 5:
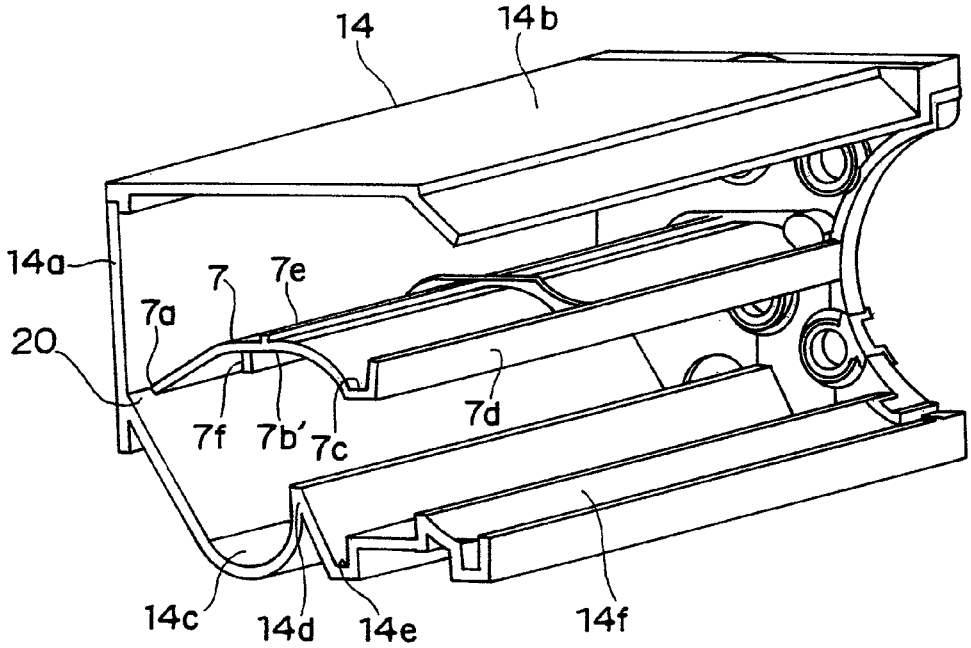
FIG. 5 is a view showing the housing having a partition member seen from a obliquely upper side.
Figure 6:
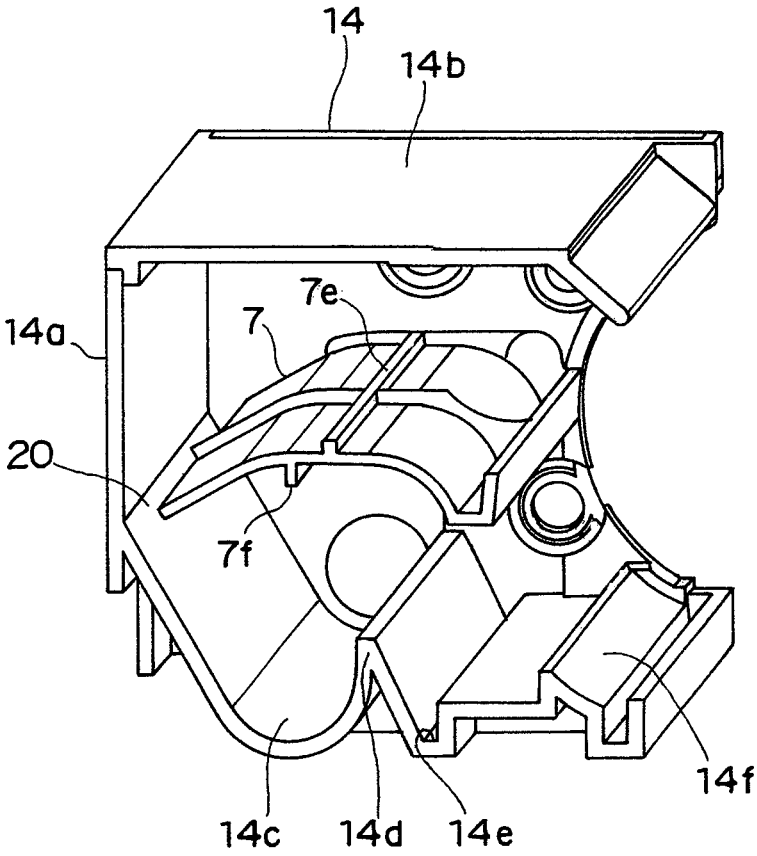
FIG. 6 is a view showing the housing having a partition member seen from another angle.

FIG. 5 and FIG. 6 show the inside of the housing 14 having a partition member 7 as seen from a obliquely upper side. As is clear from FIG. 5, a rib 7*e* projecting upward is provided on the upper surface of the curved section 7*b*' of the partition member 7, whereas a rib 7*f* projecting downward is provided on the lower surface of the curved section 7*b*' of the partition member 7.

In FIG. 3, on the bottom of the housing 14 positioned below the second cleaning section, there are provided, in order from the sidewall 14*a* side as in the example of FIG. 2, a recess-shaped toner receiving section 14*c*, a protruding section 14*d* protruding upward, a hollow section 14*e* having a side surface inclined to an upper right side from the protruding section 14*d*, and an end portion 14*f* which faces the curved region 19.

An elastic sheet 23 is attached to a slope on the left-hand side of the hollow section 14*e*. The elastic sheet 23 extends obliquely upward along the slope on the left-hand side of the hollow section 14*e* and is in contact with the collection roller 5. This prevents the toner, which was pushed up by the conveying screw 15, from flowing from the toner receiving section 14*c* to the right-hand side.

The housing 14 has a constitution similar to that shown in FIG. 4. The housing 14 extends in an elongated shape along the width direction of the intermediate transfer belt 108 (curved region 19) shown in FIG. 3. The cleaning brush 1, the collection roller 2, the regulating member 3, the cleaning brush 4, the collection roller 5, the regulating member 6, and the partition member 7 extend in an elongated shape, having the same cross section as that shown in FIG. 3 along from one end portion to the other end portion in the longitudinal direction of the housing 14. The conveying screw 15 projects out of the housing 14 through a front wall surface of the housing 14 in FIG. 4.

As shown in FIG. 3, at the time of operation, bias voltages with polarity opposite to each other are applied to the collection roller 2 and the collection roller 5 from power sources 31 and 32 as the bias voltage application sections. In this example, the collection roller 2 is provided with a negative voltage whose polarity is opposite to the main charged polarity (positive) of the residual toner 99 on the intermediate transfer belt 108. As a result, the cleaning brush 1 is charged with negative polarity identical to that of the collection roller 2. The collection roller 5 is provided with a positive voltage whose polarity is opposite to that of the collection roller 2. As a result, the cleaning brush 4 is charged with positive polarity identical to that of the collection roller 5. The roller 104 is grounded.

When the intermediate transfer belt 108 moves in the circumferential direction as shown by an arrow a in FIG. 3, most of the residual toner 99 on the intermediate transfer belt 108 is first mechanically scraped by the cleaning brush 1 while it is electrostatically attracted thereto and is removed from the intermediate transfer belt 108 with the movement of the intermediate transfer belt 108 in the circumferential direction. The toner on the cleaning brush 1 is transferred onto the collection roller 2, and the toner on the collection roller 2 is scraped by the regulating member 3. The toner scraped by the regulating member 3 flows on the upper surface of the regulating member 3 and the retaining member 9 toward the left-hand side and then drops down from the end portion 3*a* of the regulating member 3.

In this example, the left-side end portion 3*a* of the regulating member 3 is closer to the housing sidewall 14*a* than the left-side end portion 7*a* of the partition member 7 and the left-side end portion 6*a* of the regulating member 6. Therefore, the toner dropped down from the end portion 3*a* of the regulating member 3 does not land onto the partition member 7 and/or the regulating member 6, but falls smoothly to the bottom of the housing 14, more precisely to the toner receiving section 14*c*.

Next, a small quantity of opposite polarity toner which was not cleaned by the cleaning brush 1 is mechanically scraped by the cleaning brush 4 placed downstream from the cleaning brush 1 while it is electrostatically attracted thereto and is removed from the intermediate transfer belt 108. The toner on the cleaning brush 4 is transferred onto the collection roller 5, and the toner on the collection roller 5 is scraped by the regulating member 6. The toner scraped by the regulating member 6 falls to the bottom of housing 14, more precisely to the toner receiving section 14*c*.

The toner dropped to the toner receiving section 14*c* is conveyed in the longitudinal direction of the housing 14 by the conveying screw 15, and is discharged out of the housing 14 (more specifically, discharged to the toner collection box 126 shown in FIG. 1). Since the toner receiving section 14*c* is depressed in a semicircular shape, scattering of the toner within the housing 14 is suppressed.

In the cleaning device 125B, even when toner falls directly underneath from the cleaning brush 1, the collection roller 2 and from the regulating member 3 of the first cleaning section in FIG. 3 or scatters around, the second cleaning section is protected from the toner by the partition member 7. This prevents occurrence of the conventional problem of such toner scattering from the second cleaning section and adhering onto the intermediate transfer belt 108 again. Therefore, the cleaning device 125B can ensure removal of the residual toner 99 on the intermediate transfer belt 108. Moreover, since the toner adhering to the cleaning brush 4 decreases, sufficient scraping capability of the regulating member 6 which is in contact with the cleaning brush 4 can be maintained. This results in enhanced reliability. Moreover, since the partition member 7 is made of an insulating material, it can electrically insulate between the first cleaning section and the second cleaning section, so that safety can be enhanced.

The toner dropped onto the curving section 7*b*' of the partition member 7 diverges in right and left sides with the presence of the curving section 7*b*'. This makes it possible to prevent movement of the toner, i.e., back-flow of the toner from the regulating member 3 side space to the curved region 19 side (right-hand side) space in the upper part of the partition member 7 inside the housing 14. The toner diverged in the left-hand side with the curving section 7*b*' flows to the left-hand side along the slope 7*s* on the left-hand side of the curving section 7*b*', and drops down from the left-side end portion 7*a* of the partition member 7. In this example, the left-side end portion 7*a* of the partition member 7 is closer to the housing sidewall 14*a* than the left-side end portion 6*a* of the regulating member 6. Therefore, the toner dropped down from the left-side end portion 7*a* of the partition member 7 does not land onto the regulating member 6, but falls smoothly to the bottom of the housing 14, more precisely to the toner receiving section 14*c*. The toner diverged in the right-hand side with the curving section 7*b*' flows to the right-hand side along a curved surface on the right-hand side of the curving section 7*b*', and accumulates in the hollow section 7*c* together with the toner directly dropped into the hollow section 7*c*.

Moreover, the right-side end portion lib of the retaining member 11 in the first cleaning section is positioned near a rib 7*e* provided on the upper surface of the curving section 7*b*' of the partition member 7. With this, a first horizontal partition section is constituted. The first horizontal partition section horizontally partitions the space between the first cleaning section and the partition member 7 within the housing 14 into a regulating member 3 side (left-hand side) and a curved region 19 side (right-hand side). This makes it possible to prevent movement of the toner, i.e., back-flow of the toner from the left-side space to the right-side space in the upper part of the partition member 7 inside the housing 14.

Moreover, the right-side end portion 12*b* of the retaining member 12 in the second cleaning section is positioned near a rib 7*f* provided on the lower surface of the curving section 7*b*' of the partition member 7. With this, a second horizontal partition section is constituted. The second horizontal partition section horizontally partitions the space between the second cleaning section and the partition member 7 within the housing 14 into a regulating member 6 side (left-hand side) and a curved region 19 side (right-hand side). This makes it possible to prevent movement of the toner, i.e., back-flow of the toner from the left-side space to the right-side space in the lower part of the partition member 7 inside the housing 14. In short, the toner accumulated in an L-shaped corner section of the retaining member 12 is prevented from flowing to the right-hand side of the curved section 7*b*' in the second cleaning section.

In the example of FIG. 3 as in the example of FIG. 2, the regulating member 3 and the partition member 7 extend in an elongated shape from one end portion to the other end portion in the longitudinal direction of the housing 14. In short, the size of the clearance 20 between the left-side end portion 7*a* of the partition member 7 and the housing sidewall 14*a* along the longitudinal direction is substantially identical to (or it may be longer than) the size of the regulating member 3 along the longitudinal direction. Therefore, the toner dropped from the left-side end portion 3*a* of the regulating member 3 smoothly falls to the bottom of the housing 14 through the clearance 20 along the entire region in the longitudinal direction. This prevents such failure of the toner dropped from the end portion on the sidewall 14*a* side of the regulating member 3 stagnating in the vicinity of opposite ends in the longitudinal direction of the clearance 20.

Figure 7:
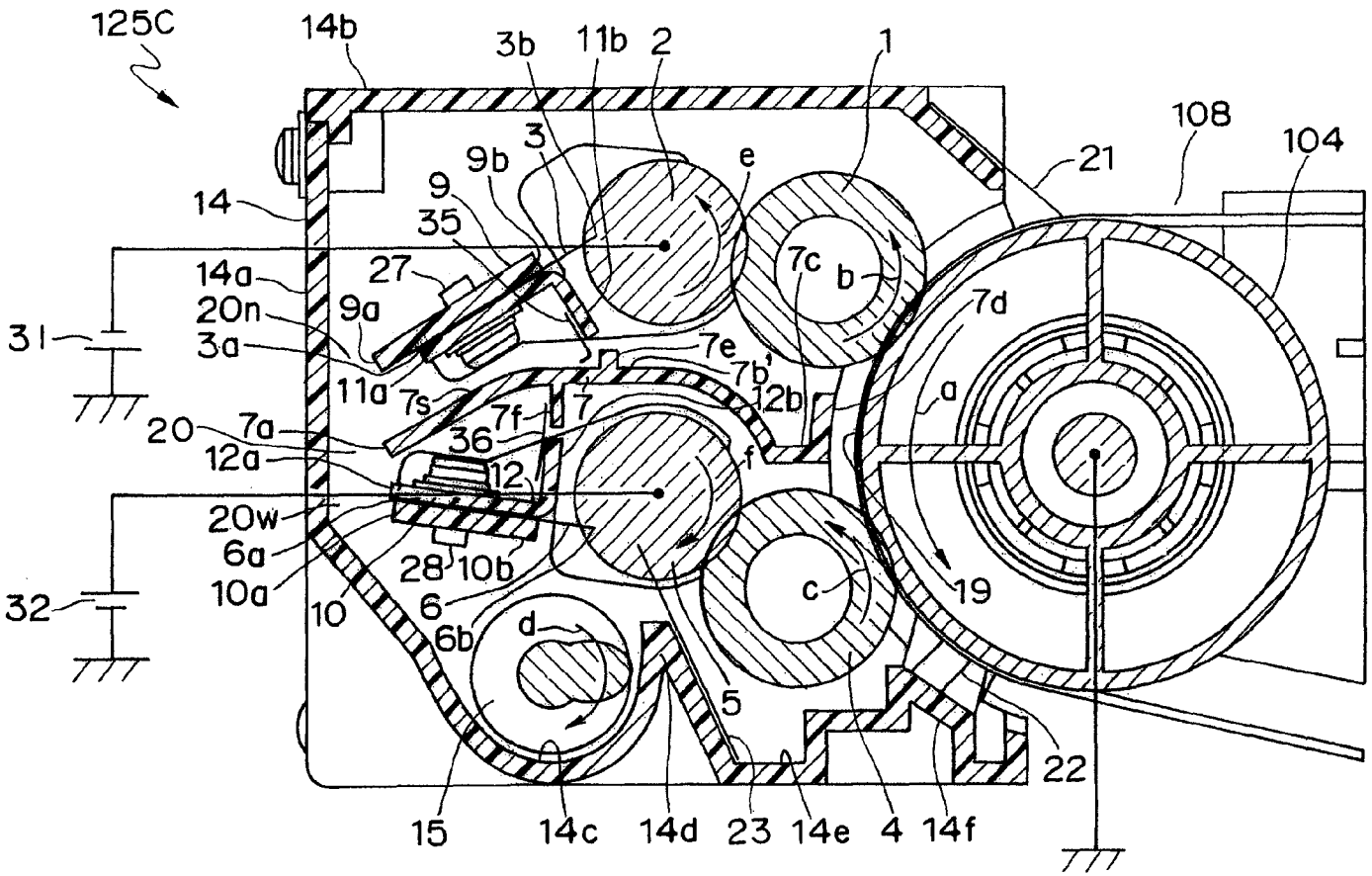
FIG. 7 is a view showing a modified example of the cleaning device of FIG. 3.

FIG. 7 shows a modified configuration example of FIG. 3 (denoted by reference sign 125C). The cleaning device 125C includes an elastic sheet 35 attached to across the right-side end portion 11*b* of the retaining member 11 and the rib 7*e* of the partition member 7 as a component of the first horizontal partition section. The elastic sheet 35 can more reliably prevent movement of the toner, i.e., back-flow of the toner from the left-side space to the right-side space in the upper part of the partition member inside the housing 14. The cleaning device 125C also includes an elastic sheet 36 attached to across the right-side end portion 12*b* of the retaining member 12 and the rib 7*f* of the partition member 7 as a component of the second horizontal partition section. The elastic sheet 36 can more reliably prevent movement of the toner, i.e., back-flow of the toner from the left-side space to the right-side space in the lower part of the partition member 7 inside the housing 14.

Figure 8:
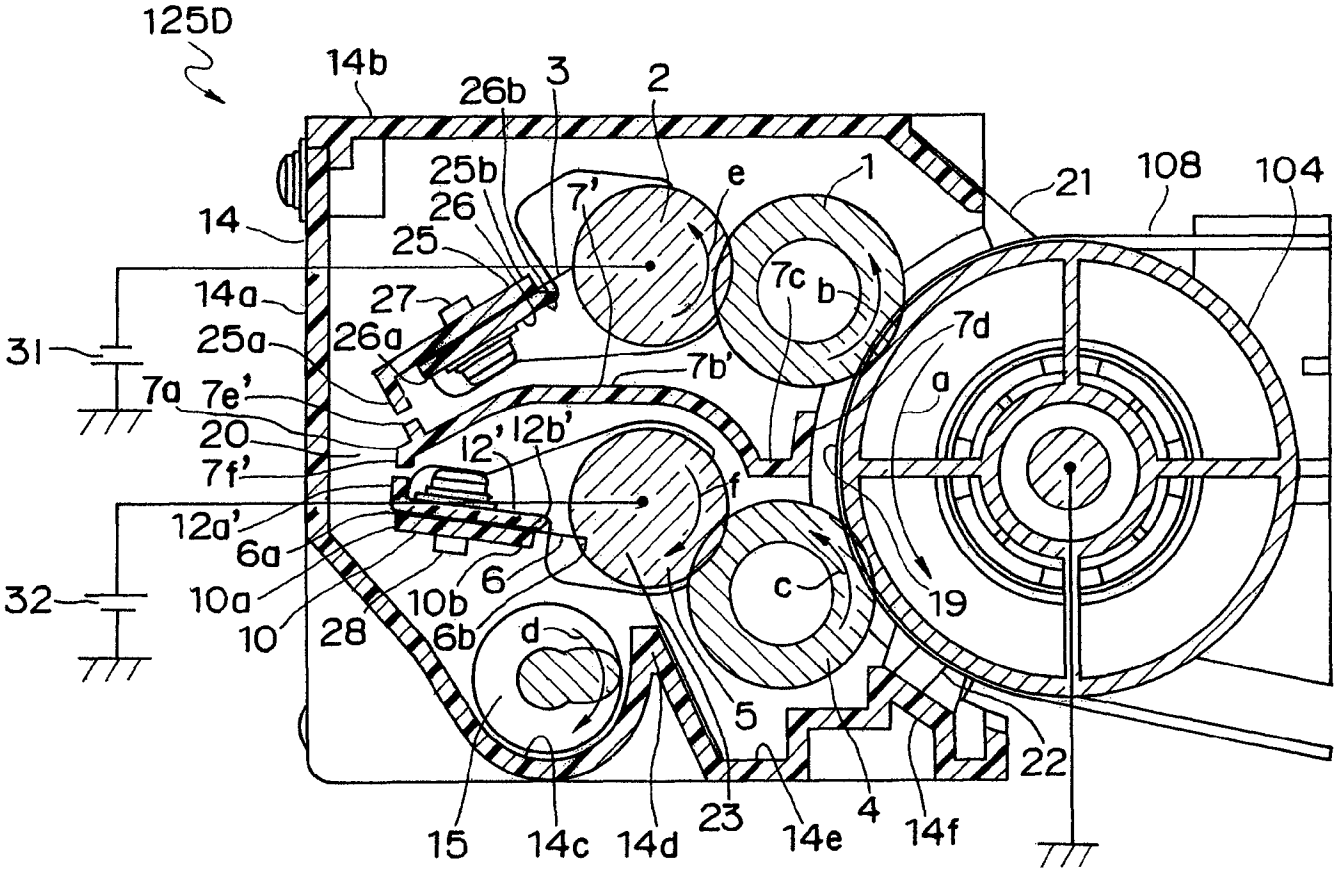
FIG. 8 is a view showing another modified example of the cleaning device of FIG. 3.

FIG. 8 shows a modified configuration example (denoted by reference sign 125D) of FIG. 3.

In the cleaning device 125D, the regulating member 3 in the first cleaning section is fixed to the housing 14 in the state of being interposed in between a pair of upper and lower retaining members 25 and 26 which are fixed to the housing 14 in place of the retaining members 9 and 11. The upper retaining member 25 is bent to have an L-shaped cross section. More specifically, a left-side end portion 25*a* of the retaining member 25 is bent obliquely toward lower right (to a later-described protruding section 7*e*' of the partition member 7). A right-side end portion 25*b* is placed along the regulating member 3. The lower retaining member 26 has a plate-like shape, with right and left end portions 26*a* and 26*b* of the retaining member 26 being placed along the regulating member 3. The regulating member 3, as well as the upper retaining member 25, is inclined to have a left-side end portion lower than a right-side end portion so that the toner carried on the upper surface flows to the left-hand side.

The regulating member 6 in the second cleaning section is fixed to the housing 14 in the state of being interposed in between a pair of upper and lower retaining members 12' and 10 fixed to the housing 14. The upper retaining member 12' is bent to have an L-shaped cross section. More specifically, a left-side end portion 12*a*' of the retaining member 12' is bent obliquely toward upper right (to a later-described protruding section 7*f*' of the partition member 7). A right-side end portion 12*b*' is placed along the regulating member 6. The lower retaining member 10 has a plate-like shape as with the one in FIG. 3, with right and left end portions 10*a* and 10*b* of the retaining member 10 being placed along the regulating member 3. The retaining member 12, as well as the regulating member 6, is inclined to have a right-side end portion 12*b*' lower than the left-side end portion 12*a*' so that the toner carried on the upper surface flows to the right-hand side.

The partition member 7' for partitioning the housing into the first cleaning section and the second cleaning section has a rib 7*e*' projecting obliquely toward upper left and a rib 7*f*' projecting downward at the left-side end portion 7*a* in place of the ribs 7*e* and 7*f* of the partition member 7 in FIG. 3.

The left-side end portion 25*a* of the retaining member 25 in the first cleaning section is positioned near the rib 7*e*' provided at the left-side end portion 7*a* of the partition member 7'. This makes it possible to prevent movement of the toner dropped down from the left-side end portion 25*a* of the retaining member 25 from moving from the housing sidewall 14*a* side (left-hand side) to the right-hand side space in the upper part of the partition member 7'.

Moreover, the left-side end portion 12*a*' of the retaining member 12' in the second cleaning section is positioned near the protruding section 7*f*' of the partition member 7. This makes it possible to prevent movement of the toner dropped down from the left-side end portion 25*a* of the retaining member 25 from moving from the housing sidewall 14*a* side (left-hand side) to the right-hand side space in the lower part of the partition member 7'.

The image forming apparatus 100 shown in FIG. 1 can ensure removal of the residual toner 99 on the intermediate transfer belt 108 with the cleaning device 125, 125A, 125B, 125C, or 125D. Therefore, the reliability of the image forming apparatus is enhanced.

It is to be noted that the cleaning brushes 1 and 4 and the collection rollers 2 and 5 may be driven by a common driving source via a gear drive.

An angle of inclination of the regulating members and 6 (and the retaining members for retaining them) should preferably be equal to or larger than the angle that allows the toner to flow naturally on the regulating members 3 and 6. The angle of inclination should preferably be at least equal to or larger the angle that allows the toner deposited on the regulating member 3 and 6 to be continuously pushed out by the toner newly scraped by the regulating members 3 and 6.

Although the cleaning device is provided beside the curved region 19 of the intermediate transfer belt 108 which is wound about the roller 104 in the disclosed embodiment, the invention is not limited thereto. The cleaning device of the invention may be provided in a flat region as a specified region of an image carrier.

As is described above, a cleaning device according to a first aspect of the present invention is a cleaning device for removing residual toner on an annular image carrier which moves in a circumferential direction, comprising:

a housing placed beside a specified region of the image carrier with respect to the circumferential direction so as to cover the specified region, the housing having a housing sidewall facing the specified region;

a first cleaning section placed in an upper part within the housing, the first cleaning section including a first cleaning brush which comes into contact with a portion of the specified region and a first regulating member placed closer to a housing sidewall side than the first cleaning brush for scraping toner on the first cleaning brush;

a second cleaning section placed in a lower part within the housing, the second cleaning section including a second cleaning brush which comes into contact with a portion of the specified region downstream from the portion with which the first cleaning brush comes into contact and a second regulating member placed closer to the housing sidewall side than the second cleaning brush for scraping toner on the second cleaning brush; and a partition member substantially extending in a continuous manner with respect to a horizontal direction from the specified region to at least a position equivalent to an end portion on the housing sidewall side of the first or the second regulating member so as to partition the housing into the first cleaning section and the second cleaning section; wherein a clearance exists between the housing sidewall and an end portion on the housing sidewall side of the partition member with respect to a horizontal direction.

In the cleaning device of one embodiment, the end portion on the housing sidewall side of the partition member is horizontally closer to the housing sidewall than the end portion on the housing sidewall side of the second regulating member.

In the cleaning device of this embodiment, the toner dropped from the end portion on the housing sidewall side of the partition member does not fall onto the second regulating member but falls smoothly to the bottom of the housing.

In the cleaning device of one embodiment, the end portion on the housing sidewall side of the first regulating member is horizontally closer to the housing sidewall than the end portion on the housing sidewall side of the partition member.

In the cleaning device of this embodiment, the toner dropped from the end portion on the housing sidewall side of the first regulating member does not drop onto the partition member but falls smoothly to the bottom of the housing through a clearance between the housing sidewall and the end portion on the housing sidewall side of the partition member.

In the cleaning device of one embodiment, a recess-shaped toner receiving section for receiving toner dropped from the first or the second regulating member or from the partition member is provided below the second cleaning section within the housing.

In the cleaning device of this embodiment, the toner dropped from the first or the second regulating member, or from the partition member is received and accumulated in a recess-shaped toner receiving section. Therefore, scattering of the toner within the housing is suppressed.

In the cleaning device of one embodiment, the housing, the first cleaning brush, the first regulating member, the second cleaning brush, the second regulating member, and the partition member extend in an elongated shape along a width direction of the specified region of the image carrier, and wherein a size of the clearance along a longitudinal direction is equal to or larger than a size of the first regulating member along a longitudinal direction.

In the cleaning device of this embodiment, the size of the clearance along the longitudinal direction is equal to or larger than the size of the first regulating member along the longitudinal direction, so that the toner dropped from the end portion on the housing sidewall side of the first regulating member smoothly falls to the bottom of the housing through the clearance along the entire region in the longitudinal direction. This prevents such failure of the toner dropped from the end portion on the sidewall side of the first regulating member stagnating in the vicinity of opposite ends in the longitudinal direction of the clearance.

The cleaning device of one embodiment comprises a bias voltage application section for applying bias voltages with polarity opposite to each other to the first cleaning brush and the second cleaning brush.

In the cleaning device of this embodiment, the bias voltage application section applies bias voltages with polarity opposite to each other to the first cleaning brush and the second cleaning brush. Therefore, even when the residual toner on the image carrier is charged with either positive or negative polarity, either the first cleaning brush or the second cleaning brush electrostatically attracts and removes the residual toner.

In the cleaning device of one embodiment, the bias voltage application section applies a bias voltage whose polarity is opposite to a main charged polarity of the residual toner on the image carrier to the first cleaning brush.

In this specification, "the main charged polarity" of the residual toner refers to the polarity possessed by most of the residual toner.

In the cleaning device of this embodiment, a part of the residual toner on the image carrier having the main charged polarity, i.e., most of the residual toner, is electrostatically attracted by the first cleaning brush and removed from the image carrier. Next, a small quantity of opposite polarity toner which was not cleaned by the first cleaning brush is electrostatically attracted by the second cleaning brush placed downstream from the first cleaning brush and is removed from the image carrier. Therefore, the image carrier is cleaned efficiently.

In the cleaning device of one embodiment, the partition member is made of an insulating material.

In the cleaning device of this embodiment, the partition member is made of an insulating material, so that the space between the first cleaning section and the second cleaning is electrically insulated. This results in enhanced reliability.

A cleaning device according to a second aspect of the present invention is a cleaning device for removing residual toner on an annular image carrier which moves in a circumferential direction, comprising:

a housing placed beside a specified region of the image carrier with respect to the circumferential direction so as to cover the specified region, the housing having a housing sidewall facing the specified region;

a first cleaning section placed in an upper part within the housing, the first cleaning section including a first cleaning brush which comes into contact with a portion of the specified region, a first collection roller placed closer to a housing sidewall side than the first cleaning brush for attracting toner on the first cleaning brush, and a first regulating member placed closer to the housing sidewall side than the first collection roller for scraping toner on the first collection roller;

a second cleaning section placed in a lower part within the housing, the second cleaning section including a second cleaning brush which comes into contact with a portion of the specified region downstream from the portion with which the first cleaning brush comes into contact, a second collection roller placed closer to the housing sidewall side than the second cleaning brush for attracting toner on the second cleaning brush, and a second regulating member placed closer to the housing sidewall side than the second collection roller for scraping toner on the second collection roller; and a partition member substantially extending in a continuous manner with respect to a horizontal direction from the specified region to at least a position equivalent to an end portion on the housing sidewall side of the first or the second regulating member so as to partition the housing into the first cleaning section and the second cleaning section; wherein a clearance exists between the housing sidewall and an end portion on the housing sidewall side of the partition member with respect to a horizontal direction.

In the cleaning device of one embodiment, the end portion on the housing sidewall side of the partition member is horizontally closer to the housing sidewall than the end portion on the housing sidewall side of the second regulating member.

In the cleaning device of this embodiment, the toner dropped from the end portion on the housing sidewall side of the partition member does not fall onto the second regulating member but falls smoothly to the bottom of the housing.

In the cleaning device of one embodiment, the end portion on the housing sidewall side of the first regulating member is horizontally closer to the housing sidewall than the end portion on the housing sidewall side of the partition member.

In the cleaning device of this embodiment, the toner dropped from the end portion on the housing sidewall side of the first regulating member does not drop onto the partition member but falls smoothly to the bottom of the housing through a clearance between the housing sidewall and the end portion on the housing sidewall side of the partition member.

The cleaning device of one embodiment comprises at least either a first horizontal partition section for horizontally partitioning a space between the first cleaning section and the partition member within the housing into a first regulating member side and a specified region side, or a second horizontal partition section for horizontally partitioning a space between the second cleaning section and the partition member within the housing into a second regulating member side and a specified region side.

In the cleaning device of this embodiment, the first horizontal partition section partitions the space between the first cleaning section and the partition member inside the housing into the first regulating member side and the specified region side with respect to the horizontal direction. This makes it possible to prevent movement of the toner, i.e., back-flow of the toner from the first regulating member-side space to the specified region-side space in the upper part of the partition member inside the housing. Alternately, the second horizontal partition section partitions the space between the second cleaning section and the partition member inside the housing into the second regulating member side and the specified region side with respect to the horizontal direction. This makes it possible to prevent movement of the toner, i.e., back-flow of the toner from the second cleaning section-side space to the specified region-side space in the lower part of the partition member inside the housing.

In the cleaning device of one embodiment, the partition member curves in a protruding manner at a position below the first collection roller in a cross section vertical to a width direction of the specified region of the image carrier.

In the cleaning device of this embodiment, the toner dropped from the first cleaning brush, the first collection roller, and from the first regulating member of the first cleaning section onto the upper surface of the partition member horizontally diverges into the first regulating member side and the specified region side with the presence of the protruding curve. This makes it possible to prevent movement of the toner, i.e., back-flow of the toner from the second cleaning section-side space to the specified region-side space in the lower part of the partition member inside the housing.

In the cleaning device of one embodiment, a recess-shaped toner receiving section for receiving toner dropped from the first or the second regulating member or from the partition member is provided below the second cleaning section within the housing.

In the cleaning device of this embodiment, the toner dropped from the first or the second regulating member, or from the partition member is received and accumulated in a recess-shaped toner receiving section. Therefore, scattering of the toner within the housing is suppressed.

In the cleaning device of one embodiment, the housing, the first cleaning brush, the first collection roller, the first regulating member, the second cleaning brush, the second collection roller, the second regulating member, and the partition member extend in an elongated shape along a width direction of the specified region of the image carrier, and wherein a size of the clearance along a longitudinal direction is equal to or larger than a size of the first and the second regulating members along a longitudinal direction.

In the cleaning device of this embodiment, the size of the clearance along the longitudinal direction is equal to or larger than the size of the first regulating member along the longitudinal direction, so that the toner dropped from the end portion on the housing sidewall side of the first regulating member smoothly falls to the bottom of the housing through the clearance along the entire region in the longitudinal direction. This prevents such failure of the toner dropped from the end portion on the sidewall side of the first regulating member stagnating in the vicinity of opposite ends in the longitudinal direction of the clearance.

The cleaning device of one embodiment comprises a bias voltage application section for applying bias voltages with polarity opposite to each other to the first collection roller and the second collection roller.

In the cleaning device of this embodiment, the bias voltage application section applies bias voltages with polarity opposite to each other to the first collection roller and the second collection roller. Accordingly, the first cleaning brush and the second cleaning brush are charged with polarity opposite to each other. Therefore, even when the residual toner on the image carrier is charged with either positive or negative polarity, either the first cleaning brush or the second cleaning brush electrostatically attracts and removes the residual toner.

In the cleaning device of one embodiment, the bias voltage application section applies a bias voltage whose polarity is opposite to a main charged polarity of the residual toner on the image carrier to the first collection roller.

In the cleaning device of this embodiment, a part of the residual toner on the image carrier having the main charged polarity, i.e., most of the residual toner, is electrostatically attracted by the first cleaning brush and removed from the image carrier. Next, a small quantity of opposite polarity toner which was not cleaned by the first cleaning brush is electrostatically attracted by the second cleaning brush placed downstream from the first cleaning brush and is removed from the image carrier. Therefore, the image carrier is cleaned efficiently.

In the cleaning device of one embodiment, the partition member is made of an insulating material.

In the cleaning device of this embodiment, the partition member is made of an insulating material, so that the space between the first cleaning section and the second cleaning is electrically insulated. This results in enhanced reliability.

An image forming apparatus according to the present invention comprises the cleaning device described above.

The image forming apparatus of the invention can ensure removal of the residual toner on the image carrier with the cleaning device. Therefore, the reliability of the image forming apparatus is enhanced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

REFERENCE SIGNS LIST

1, 4 cleaning brush
2, 5 collection roller
3, 6 regulating member
7, 7' partition member
14 housing
20, 20*n*, 20*w* clearance
100 image forming apparatus Citation List Patent Literature Reference 1: JP 2002-229344 A

The invention claimed is:

1. A cleaning device for removing residual toner on an annular image carrier which moves in a circumferential direction, comprising:

a housing placed beside a specified region of the image carrier with respect to the circumferential direction so as to cover the specified region, the housing having a housing sidewall facing the specified region;

a first cleaning section placed in an upper part within the housing, the first cleaning section including a first cleaning brush which comes into contact with a portion of the specified region and a first regulating member having a blade that is placed closer to a housing sidewall side than the first cleaning brush for scraping toner on the first cleaning brush;

a second cleaning section placed in a lower part within the housing, the second cleaning section including a second cleaning brush which comes into contact with a portion of the specified region downstream from the portion with which the first cleaning brush comes into contact and a second regulating member having a blade that is placed closer to the housing sidewall side than the second cleaning brush for scraping toner on the second cleaning brush; and a partition member substantially extending in a continuous manner with respect to a horizontal direction from the specified region to at least a position between end portions on the housing sidewall side of the first and the second regulating members so as to partition the housing into the first cleaning section and the second cleaning section; wherein a clearance exists between the housing sidewall and an end portion on the housing sidewall side of the partition member with respect to a horizontal direction, and a space between the first cleaning section and the second cleaning section electrically insulates the first cleaning section from the second cleaning section.

2. The cleaning device as claimed in claim 1, wherein the end portion on the housing sidewall side of the partition member is horizontally closer to the housing sidewall than the end portion on the housing sidewall side of the second regulating member.

3. The cleaning device as claimed in claim 1, wherein the end portion on the housing sidewall side of the first regulating member is horizontally closer to the housing sidewall than the end portion on the housing sidewall side of the partition member.

4. The cleaning device as claimed in claim 1, wherein a recess-shaped toner receiving section for receiving toner dropped from the first or the second regulating member or from the partition member is provided below the second cleaning section within the housing.

5. The cleaning device as claimed in claim 1, wherein the housing, the first cleaning brush, the first regulating member, the second cleaning brush, the second regulating member, and the partition member extend in an elongated shape along a width direction of the specified region of the image carrier, and wherein a size of the clearance along a longitudinal direction is equal to or larger than a size of the first regulating member along a longitudinal direction.

6. The cleaning device as claimed in claim 1, comprising a bias voltage application section for applying bias voltages with polarity opposite to each other to the first cleaning brush and the second cleaning brush.

7. The cleaning device as claimed in claim 6, wherein the bias voltage application section applies a bias voltage whose polarity is opposite to a main charged polarity of the residual toner on the image carrier to the first cleaning brush.

8. The cleaning device as claimed in claim 1, wherein the partition member is made of an insulating material.

9. An image forming apparatus comprising the cleaning device as claimed in claim 1.

10. The cleaning device as claimed in claim 1, wherein a recess-shaped toner receiving section for receiving toner dropped from the first and the second regulating member is provided below the second cleaning section within the housing.

11. The cleaning device as claimed in claim 1, comprising a bias voltage application section for directly applying bias voltages with polarity opposite to each other to the first cleaning brush and the second cleaning brush.

* * * * *